US009944091B2

(12) United States Patent
Verdugo et al.

(10) Patent No.: US 9,944,091 B2
(45) Date of Patent: Apr. 17, 2018

(54) PRINTER CONTROL SECTION, METHOD AND PRINTER

(71) Applicant: Hewlett-Packard Development Company, L.P., Houston, TX (US)

(72) Inventors: Antonio Gracia Verdugo, Barcelona (ES); Joan Albert Jorba Closa, Sant Cugat del Valles (ES); Marina Cantero Lazaro, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/275,964

(22) Filed: Sep. 26, 2016

(65) Prior Publication Data

US 2017/0087880 A1 Mar. 30, 2017

Related U.S. Application Data

(63) Continuation of application No. 14/762,150, filed as application No. PCT/EP2013/051473 on Jan. 25, 2013, now Pat. No. 9,469,122.

(51) Int. Cl.
*B41J 2/01* (2006.01)
*B41J 11/00* (2006.01)

(52) U.S. Cl.
CPC ..... *B41J 11/0015* (2013.01); *B41J 2/01* (2013.01)

(58) Field of Classification Search
CPC .. B41J 2/04581; B41J 2/2114; B41J 11/0015; B41J 29/393; B41J 29/38; B41J 2/2132; B41J 2/01; B41J 2/15; B41J 2/21
(Continued)

(56) References Cited

U.S. PATENT DOCUMENTS 6,464,330 B1 10/2002 Miller et al.
6,565,192 B1 5/2003 Vinals et al.
(Continued)

FOREIGN PATENT DOCUMENTS

CN 101391518 3/2009
CN 101934634 1/2011
(Continued)

OTHER PUBLICATIONS

Boley, J.W. et al. "Coalescence constraints for inkjet print mask optimization", IEEE/ASME International Conference on Advanced Intelligent Mechatronics, Jul. 6-9, 2010, pp. 67-72.
(Continued)

*Primary Examiner* — Jannelle M Lebron
(74) *Attorney, Agent, or Firm* — HP Inc. Patent Department

(57) ABSTRACT

A printer control section arranged to control a printhead, is operable to cause the printhead to: perform a plurality of passes over a swath of a print medium, the plurality of passes including first and second treatment passes; apply treatment to the print medium in each of the treatment passes, the treatment in each treatment pass being applied according to a respective treatment mask, wherein each treatment mask indicates a corresponding set of pixels to which the treatment may be applied in a pass to which the treatment mask is applied, the treatment mask having a weight indicative of the proportion of pixels in the corresponding set of pixels, and the treatment masks of the first and second passes are such that a weight of the first treatment mask is different from a weight of the second treatment mask.

16 Claims, 7 Drawing Sheets

(58) Field of Classification Search
USPC ..... 347/9, 14, 16, 21, 95, 101, 104
See application file for complete search history.

(56) References Cited

U.S. PATENT DOCUMENTS

| | | | |
|---|---|---|---|
| 7,988,251 | B2 | 8/2011 | Dimitrijevic et al. |
| 8,083,337 | B2 | 12/2011 | Takekoshi et al. |
| 8,272,710 | B2 | 9/2012 | Spaulding et al. |
| 2009/0315932 | A1 | 12/2009 | Dimitrijevic et al. |
| 2010/0013878 | A1 | 1/2010 | Spaulding et al. |
| 2010/0328388 | A1 | 12/2010 | Takekoshi et al. |
| 2010/0328389 | A1 | 12/2010 | Kunimine et al. |
| 2011/0216110 | A1 | 9/2011 | Kunimine et al. |

FOREIGN PATENT DOCUMENTS

| | | |
|---|---|---|
| EP | 0726158 | 8/1996 |
| EP | 1029693 | 8/2000 |
| EP | 1288003 | 3/2003 |
| EP | 2039523 | 3/2009 |
| JP | 3876947 | 2/2007 |

OTHER PUBLICATIONS

International Search Report and Written Opinion for PCT/EP2013/051473 dated Oct. 7, 2013, 9 pp.

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 2 | 1 | 1 | 3 | 2 | 2 | 0 | 3 | 2 | 0 | 0 | 3 | 3 | 2 | 0 | 2 | 1 | 3 | 0 | 0 | 2 | 3 | 0 | 3 | 2 | 0 | 3 | 3 | 2 | 0 | 1 | 0 |
| 2 | 2 | 0 | 2 | 3 | 1 | 2 | 1 | 3 | 3 | 1 | 0 | 0 | 3 | 0 | 1 | 0 | 2 | 3 | 3 | 1 | 2 | 0 | 3 | 3 | 1 | 0 | 3 | 0 | 1 | 1 | 1 |
| 0 | 0 | 1 | 1 | 2 | 2 | 3 | 2 | 3 | 0 | 1 | 0 | 2 | 1 | 2 | 3 | 2 | 3 | 2 | 3 | 2 | 2 | 3 | 1 | 1 | 1 | 3 | 2 | 3 | 3 | 3 | 0 |
| 1 | 2 | 1 | 1 | 3 | 3 | 0 | 3 | 1 | 2 | 3 | 0 | 0 | 1 | 1 | 3 | 3 | 0 | 0 | 1 | 0 | 0 | 0 | 1 | 0 | 2 | 1 | 0 | 1 | 1 | 2 | 3 |
| 3 | 0 | 2 | 2 | 1 | 1 | 3 | 1 | 2 | 3 | 0 | 1 | 1 | 3 | 3 | 0 | 0 | 3 | 1 | 0 | 1 | 3 | 0 | 1 | 3 | 0 | 2 | 1 | 2 | 3 | 2 | 3 |
| 2 | 0 | 3 | 0 | 2 | 2 | 2 | 3 | 2 | 1 | 2 | 2 | 1 | 1 | 3 | 3 | 0 | 3 | 1 | 1 | 2 | 1 | 2 | 0 | 2 | 2 | 2 | 0 | 2 | 1 | 3 | 0 |
| 1 | 1 | 2 | 1 | 0 | 3 | 3 | 0 | 3 | 2 | 3 | 1 | 1 | 1 | 3 | 0 | 3 | 1 | 1 | 0 | 0 | 1 | 2 | 3 | 2 | 1 | 0 | 2 | 2 | 2 | 0 | 3 |
| 3 | 2 | 3 | 3 | 1 | 3 | 2 | 1 | 1 | 3 | 1 | 3 | 3 | 0 | 0 | 1 | 0 | 0 | 0 | 2 | 1 | 2 | 1 | 0 | 0 | 0 | 1 | 2 | 1 | 2 | 1 | 0 |
| 3 | 3 | 0 | 3 | 3 | 2 | 2 | 3 | 0 | 3 | 0 | 2 | 0 | 2 | 3 | 3 | 0 | 1 | 2 | 0 | 1 | 2 | 1 | 3 | 3 | 0 | 2 | 0 | 1 | 1 | 3 | 3 |
| 1 | 2 | 3 | 3 | 1 | 2 | 2 | 2 | 2 | 3 | 3 | 2 | 2 | 3 | 1 | 0 | 3 | 3 | 1 | 3 | 2 | 2 | 2 | 2 | 3 | 0 | 2 | 0 | 2 | 2 | 3 | 2 |
| 2 | 3 | 1 | 0 | 1 | 0 | 3 | 0 | 0 | 0 | 1 | 3 | 1 | 0 | 1 | 3 | 3 | 0 | 3 | 2 | 0 | 3 | 1 | 2 | 1 | 2 | 0 | 0 | 1 | 2 | 0 | 3 |
| 3 | 0 | 3 | 2 | 0 | 1 | 1 | 2 | 3 | 3 | 0 | 2 | 3 | 2 | 2 | 3 | 2 | 1 | 3 | 1 | 2 | 0 | 3 | 2 | 3 | 3 | 2 | 2 | 2 | 3 | 2 | 2 |
| 2 | 0 | 1 | 3 | 0 | 2 | 1 | 1 | 3 | 2 | 3 | 1 | 3 | 1 | 3 | 1 | 0 | 3 | 1 | 2 | 2 | 3 | 2 | 2 | 1 | 3 | 1 | 1 | 0 | 0 | 1 | 2 |
| 2 | 2 | 2 | 3 | 0 | 2 | 0 | 2 | 0 | 3 | 2 | 3 | 0 | 1 | 3 | 0 | 0 | 0 | 1 | 0 | 1 | 2 | 1 | 0 | 2 | 1 | 1 | 2 | 1 | 0 | 3 | 1 |
| 3 | 2 | 0 | 3 | 3 | 2 | 1 | 1 | 0 | 0 | 0 | 3 | 1 | 3 | 2 | 0 | 0 | 1 | 2 | 3 | 0 | 3 | 2 | 0 | 3 | 3 | 3 | 0 | 0 | 3 | 0 | 2 |
| 1 | 3 | 2 | 2 | 2 | 0 | 2 | 1 | 2 | 1 | 0 | 2 | 2 | 1 | 1 | 0 | 3 | 2 | 3 | 3 | 2 | 1 | 1 | 1 | 2 | 3 | 2 | 3 | 0 | 2 | 1 | 1 |
| 0 | 1 | 1 | 0 | 1 | 3 | 2 | 2 | 0 | 3 | 3 | 0 | 0 | 0 | 0 | 0 | 2 | 1 | 0 | 3 | 0 | 3 | 1 | 0 | 0 | 3 | 0 | 1 | 2 | 2 | 1 | 3 |
| 1 | 1 | 3 | 2 | 3 | 1 | 2 | 2 | 3 | 1 | 0 | 3 | 0 | 1 | 1 | 2 | 1 | 1 | 0 | 2 | 2 | 0 | 2 | 1 | 0 | 3 | 3 | 3 | 3 | 1 | 1 | 1 |
| 2 | 2 | 2 | 3 | 3 | 1 | 1 | 2 | 1 | 2 | 2 | 0 | 2 | 3 | 3 | 1 | 1 | 3 | 1 | 2 | 3 | 1 | 0 | 3 | 1 | 2 | 2 | 2 | 2 | 1 | 3 | 0 |
| 3 | 3 | 2 | 2 | 0 | 1 | 0 | 3 | 3 | 2 | 3 | 3 | 2 | 3 | 0 | 1 | 0 | 0 | 2 | 2 | 1 | 3 | 0 | 3 | 0 | 3 | 3 | 3 | 2 | 0 | 2 | 0 |
| 3 | 3 | 2 | 0 | 3 | 3 | 1 | 0 | 3 | 0 | 2 | 0 | 1 | 2 | 1 | 1 | 0 | 1 | 0 | 3 | 0 | 3 | 3 | 1 | 0 | 3 | 3 | 1 | 2 | 2 | 1 | 1 |
| 3 | 3 | 1 | 3 | 3 | 2 | 3 | 2 | 1 | 0 | 0 | 2 | 1 | 1 | 0 | 0 | 2 | 2 | 2 | 2 | 2 | 3 | 1 | 1 | 2 | 2 | 0 | 1 | 2 | 0 | 0 | 3 |
| 1 | 3 | 2 | 2 | 2 | 1 | 1 | 0 | 0 | 2 | 2 | 0 | 0 | 3 | 1 | 3 | 3 | 0 | 3 | 0 | 1 | 3 | 3 | 0 | 1 | 0 | 1 | 0 | 3 | 0 | 0 | 2 |
| 1 | 2 | 3 | 3 | 0 | 2 | 1 | 0 | 3 | 3 | 0 | 2 | 0 | 3 | 0 | 3 | 0 | 0 | 1 | 2 | 1 | 0 | 2 | 3 | 2 | 2 | 1 | 3 | 0 | 0 | 3 | 0 |
| 2 | 1 | 0 | 3 | 3 | 0 | 1 | 0 | 3 | 3 | 2 | 1 | 0 | 2 | 0 | 1 | 3 | 1 | 1 | 2 | 2 | 0 | 2 | 0 | 1 | 2 | 0 | 1 | 2 | 3 | 1 | 2 |
| 3 | 1 | 3 | 3 | 1 | 1 | 1 | 2 | 3 | 3 | 1 | 1 | 3 | 1 | 1 | 1 | 2 | 3 | 3 | 2 | 0 | 0 | 2 | 0 | 0 | 3 | 1 | 0 | 3 | 0 | 3 | 3 |
| 1 | 3 | 1 | 0 | 1 | 3 | 2 | 1 | 1 | 3 | 1 | 0 | 1 | 3 | 1 | 3 | 1 | 2 | 1 | 0 | 0 | 0 | 1 | 2 | 0 | 0 | 0 | 2 | 3 | 3 | 2 | 0 |
| 1 | 1 | 2 | 3 | 0 | 3 | 0 | 0 | 3 | 1 | 0 | 0 | 1 | 2 | 1 | 2 | 0 | 1 | 3 | 0 | 1 | 1 | 1 | 1 | 0 | 1 | 1 | 0 | 2 | 1 | 1 | 1 |
| 1 | 0 | 0 | 2 | 2 | 2 | 3 | 1 | 0 | 1 | 0 | 3 | 1 | 0 | 0 | 0 | 0 | 1 | 2 | 0 | 2 | 3 | 1 | 3 | 1 | 1 | 0 | 2 | 3 | 1 | 2 | 3 |
| 2 | 2 | 3 | 2 | 1 | 1 | 2 | 3 | 3 | 3 | 3 | 3 | 3 | 3 | 1 | 1 | 1 | 0 | 1 | 0 | 1 | 1 | 0 | 2 | 2 | 2 | 3 | 1 | 3 | 1 | 1 | 2 |
| 2 | 2 | 1 | 2 | 3 | 1 | 0 | 3 | 1 | 0 | 1 | 1 | 3 | 1 | 0 | 2 | 3 | 1 | 1 | 2 | 3 | 2 | 0 | 1 | 3 | 0 | 1 | 3 | 1 | 3 | 2 | 3 |
| 0 | 3 | 1 | 3 | 1 | 1 | 0 | 0 | 0 | 1 | 3 | 3 | 3 | 2 | 1 | 0 | 0 | 0 | 1 | 3 | 3 | 2 | 2 | 3 | 1 | 2 | 3 | 0 | 2 | 1 | 1 | 0 |

FIG. 2a

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 2 | 1 | 1 | 3 | 2 | 2 | 0 | 3 | 2 | 0 | 0 | 3 | 3 | 2 | 0 | 2 | 1 | 3 | 0 | 0 | 2 | 3 | 0 | 3 | 2 | 0 | 3 | 3 | 2 | 0 | 1 | 0 |
| 2 | 2 | 0 | 2 | 3 | 1 | 2 | 1 | 3 | 3 | 1 | 0 | 0 | 3 | 0 | 1 | 0 | 2 | 3 | 3 | 1 | 2 | 0 | 3 | 3 | 1 | 0 | 3 | 0 | 1 | 1 | 1 |
| 0 | 0 | 1 | 1 | 2 | 2 | 3 | 2 | 3 | 0 | 1 | 0 | 2 | 1 | 2 | 3 | 2 | 3 | 2 | 3 | 2 | 2 | 3 | 1 | 1 | 1 | 3 | 2 | 3 | 3 | 3 | 0 |
| 1 | 2 | 1 | 1 | 3 | 3 | 0 | 3 | 1 | 2 | 3 | 0 | 0 | 1 | 1 | 3 | 3 | 0 | 0 | 1 | 0 | 0 | 0 | 1 | 0 | 2 | 1 | 0 | 1 | 1 | 2 | 3 |
| 3 | 0 | 2 | 2 | 1 | 1 | 3 | 1 | 2 | 3 | 0 | 1 | 1 | 3 | 3 | 0 | 0 | 3 | 1 | 0 | 1 | 3 | 0 | 1 | 3 | 0 | 2 | 1 | 2 | 3 | 2 | 3 |
| 2 | 0 | 3 | 0 | 2 | 2 | 2 | 3 | 2 | 1 | 2 | 2 | 1 | 1 | 3 | 3 | 0 | 3 | 1 | 1 | 2 | 1 | 2 | 0 | 2 | 2 | 2 | 0 | 2 | 1 | 3 | 0 |
| 1 | 1 | 2 | 1 | 0 | 3 | 3 | 0 | 3 | 2 | 3 | 1 | 1 | 1 | 3 | 0 | 3 | 1 | 1 | 0 | 0 | 1 | 2 | 3 | 2 | 1 | 0 | 2 | 2 | 2 | 0 | 3 |
| 3 | 2 | 3 | 3 | 1 | 3 | 2 | 1 | 1 | 3 | 1 | 3 | 3 | 0 | 0 | 1 | 0 | 0 | 0 | 2 | 1 | 2 | 1 | 0 | 0 | 0 | 1 | 2 | 1 | 2 | 1 | 0 |
| 3 | 3 | 0 | 3 | 3 | 2 | 2 | 3 | 0 | 3 | 0 | 2 | 0 | 2 | 3 | 3 | 0 | 1 | 2 | 0 | 1 | 2 | 1 | 3 | 3 | 0 | 2 | 0 | 1 | 1 | 3 | 3 |
| 1 | 2 | 3 | 3 | 1 | 2 | 2 | 2 | 2 | 3 | 3 | 2 | 2 | 3 | 1 | 0 | 3 | 3 | 1 | 3 | 2 | 2 | 2 | 2 | 3 | 0 | 2 | 0 | 2 | 2 | 3 | 2 |
| 2 | 3 | 1 | 0 | 1 | 0 | 3 | 0 | 0 | 0 | 1 | 3 | 1 | 0 | 1 | 3 | 3 | 0 | 3 | 2 | 0 | 3 | 1 | 2 | 1 | 2 | 0 | 0 | 1 | 2 | 0 | 3 |
| 3 | 0 | 3 | 2 | 0 | 1 | 1 | 2 | 3 | 3 | 0 | 2 | 3 | 2 | 2 | 3 | 2 | 1 | 3 | 1 | 2 | 0 | 3 | 2 | 3 | 3 | 2 | 2 | 2 | 3 | 2 | 2 |
| 2 | 0 | 1 | 3 | 0 | 2 | 1 | 1 | 3 | 2 | 3 | 1 | 3 | 1 | 3 | 1 | 0 | 3 | 1 | 2 | 2 | 3 | 2 | 2 | 1 | 3 | 1 | 1 | 0 | 0 | 1 | 2 |
| 2 | 2 | 2 | 3 | 0 | 2 | 0 | 2 | 0 | 3 | 2 | 3 | 0 | 1 | 3 | 0 | 0 | 0 | 1 | 0 | 1 | 2 | 1 | 0 | 2 | 1 | 1 | 2 | 1 | 0 | 3 | 1 |
| 3 | 2 | 0 | 3 | 3 | 2 | 1 | 1 | 0 | 0 | 0 | 3 | 1 | 3 | 2 | 0 | 0 | 1 | 2 | 3 | 0 | 3 | 2 | 0 | 3 | 3 | 3 | 0 | 0 | 3 | 0 | 2 |
| 1 | 3 | 2 | 2 | 2 | 0 | 2 | 1 | 2 | 1 | 0 | 2 | 2 | 1 | 1 | 0 | 3 | 2 | 3 | 3 | 2 | 1 | 1 | 1 | 2 | 3 | 2 | 3 | 0 | 2 | 1 | 1 |
| 0 | 1 | 1 | 0 | 1 | 3 | 2 | 2 | 0 | 3 | 3 | 0 | 0 | 0 | 0 | 0 | 2 | 1 | 0 | 3 | 0 | 3 | 1 | 0 | 0 | 3 | 0 | 1 | 2 | 2 | 1 | 3 |
| 1 | 1 | 3 | 2 | 3 | 1 | 2 | 2 | 3 | 1 | 0 | 3 | 0 | 1 | 1 | 2 | 1 | 1 | 0 | 2 | 2 | 0 | 2 | 1 | 0 | 3 | 3 | 3 | 3 | 1 | 1 | 1 |
| 2 | 2 | 2 | 3 | 3 | 1 | 1 | 2 | 1 | 2 | 2 | 0 | 2 | 3 | 3 | 1 | 1 | 3 | 1 | 2 | 3 | 1 | 0 | 3 | 1 | 2 | 2 | 2 | 2 | 1 | 3 | 0 |
| 3 | 3 | 2 | 2 | 0 | 1 | 0 | 3 | 3 | 2 | 3 | 3 | 2 | 3 | 0 | 1 | 0 | 0 | 2 | 2 | 1 | 3 | 0 | 3 | 0 | 3 | 3 | 3 | 2 | 0 | 2 | 0 |
| 3 | 3 | 2 | 0 | 3 | 3 | 1 | 0 | 3 | 0 | 2 | 0 | 1 | 2 | 1 | 1 | 0 | 1 | 0 | 3 | 0 | 3 | 3 | 1 | 0 | 3 | 3 | 1 | 2 | 2 | 1 | 1 |
| 3 | 3 | 1 | 3 | 3 | 2 | 3 | 2 | 1 | 0 | 0 | 2 | 1 | 1 | 0 | 0 | 2 | 2 | 2 | 2 | 2 | 3 | 1 | 1 | 2 | 2 | 0 | 1 | 2 | 0 | 0 | 3 |
| 1 | 3 | 2 | 2 | 2 | 1 | 1 | 0 | 0 | 2 | 2 | 0 | 0 | 3 | 1 | 3 | 3 | 0 | 3 | 0 | 1 | 3 | 3 | 0 | 1 | 0 | 1 | 0 | 3 | 0 | 0 | 2 |
| 1 | 2 | 3 | 3 | 0 | 2 | 1 | 0 | 3 | 3 | 0 | 2 | 0 | 3 | 0 | 3 | 0 | 0 | 1 | 2 | 1 | 0 | 2 | 3 | 2 | 2 | 1 | 3 | 0 | 0 | 3 | 0 |
| 2 | 1 | 0 | 3 | 3 | 0 | 1 | 0 | 3 | 3 | 2 | 1 | 0 | 2 | 0 | 1 | 3 | 1 | 1 | 2 | 2 | 0 | 2 | 0 | 1 | 2 | 0 | 1 | 2 | 3 | 1 | 2 |
| 3 | 1 | 3 | 3 | 1 | 1 | 1 | 2 | 3 | 3 | 1 | 1 | 3 | 1 | 1 | 1 | 2 | 3 | 3 | 2 | 0 | 0 | 2 | 0 | 0 | 3 | 1 | 0 | 3 | 0 | 3 | 3 |
| 1 | 3 | 1 | 0 | 1 | 3 | 2 | 1 | 1 | 3 | 1 | 0 | 1 | 3 | 1 | 3 | 1 | 2 | 1 | 0 | 0 | 0 | 1 | 2 | 0 | 0 | 0 | 2 | 3 | 3 | 2 | 0 |
| 1 | 1 | 2 | 3 | 0 | 3 | 0 | 0 | 3 | 1 | 0 | 0 | 1 | 2 | 1 | 2 | 0 | 1 | 3 | 0 | 1 | 1 | 1 | 1 | 0 | 1 | 1 | 0 | 2 | 1 | 1 | 1 |
| 1 | 0 | 0 | 2 | 2 | 2 | 3 | 1 | 0 | 1 | 0 | 3 | 1 | 0 | 0 | 0 | 0 | 1 | 2 | 0 | 2 | 3 | 1 | 3 | 1 | 1 | 0 | 2 | 3 | 1 | 2 | 3 |
| 2 | 2 | 3 | 2 | 1 | 1 | 2 | 3 | 3 | 3 | 3 | 3 | 3 | 3 | 1 | 1 | 1 | 0 | 1 | 0 | 1 | 1 | 0 | 2 | 2 | 2 | 3 | 1 | 3 | 1 | 1 | 2 |
| 2 | 2 | 1 | 2 | 3 | 1 | 0 | 3 | 1 | 0 | 1 | 1 | 3 | 1 | 0 | 2 | 3 | 1 | 1 | 2 | 3 | 2 | 0 | 1 | 3 | 0 | 1 | 3 | 1 | 3 | 2 | 3 |
| 0 | 3 | 1 | 3 | 1 | 1 | 0 | 0 | 0 | 1 | 3 | 3 | 3 | 2 | 1 | 0 | 0 | 0 | 1 | 3 | 3 | 2 | 2 | 3 | 1 | 2 | 3 | 0 | 2 | 1 | 1 | 0 |

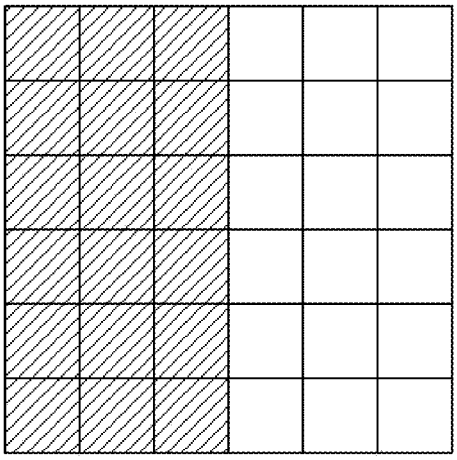
FIG. 7a
| | | | | | |
|---|---|---|---|---|---|
| 0 | 0 | 1 | 0 | 0 | 1 |
| 1 | 0 | 0 | 1 | 0 | 0 |
| 0 | 1 | 0 | 0 | 1 | 0 |
| 0 | 0 | 1 | 0 | 0 | 1 |
| 1 | 0 | 0 | 1 | 0 | 0 |
| 0 | 1 | 0 | 0 | 1 | 0 |
FIG. 7b
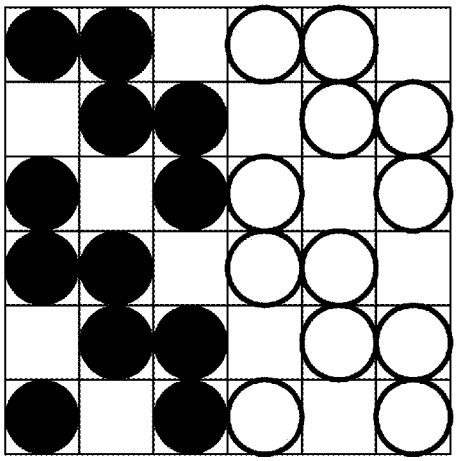
FIG. 7c
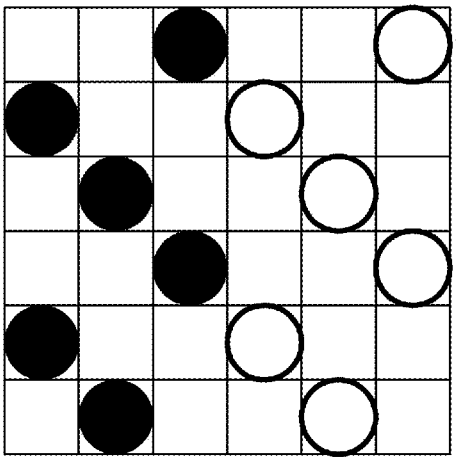
FIG. 7d

PRINTER CONTROL SECTION, METHOD AND PRINTER

BACKGROUND

In some printing devices a pretreatment may be applied to a print medium prior to printing on the medium with colored inks. In some devices the pretreatment may be applied by a print head.

BRIEF DESCRIPTION OF THE DRAWINGS

Examples of the invention are further described hereinafter with reference to the accompanying drawings, in which:

FIGS. 2*a* and 2*b* show an example of a proportional print mask.

FIGS. 7*a*, 7*b*, 7*c*, and 7*d* show an example of applying a non-proportional pretreatment mask when pretreatment is to be applied to a part of a swath.

DETAILED DESCRIPTION

Figure 1:
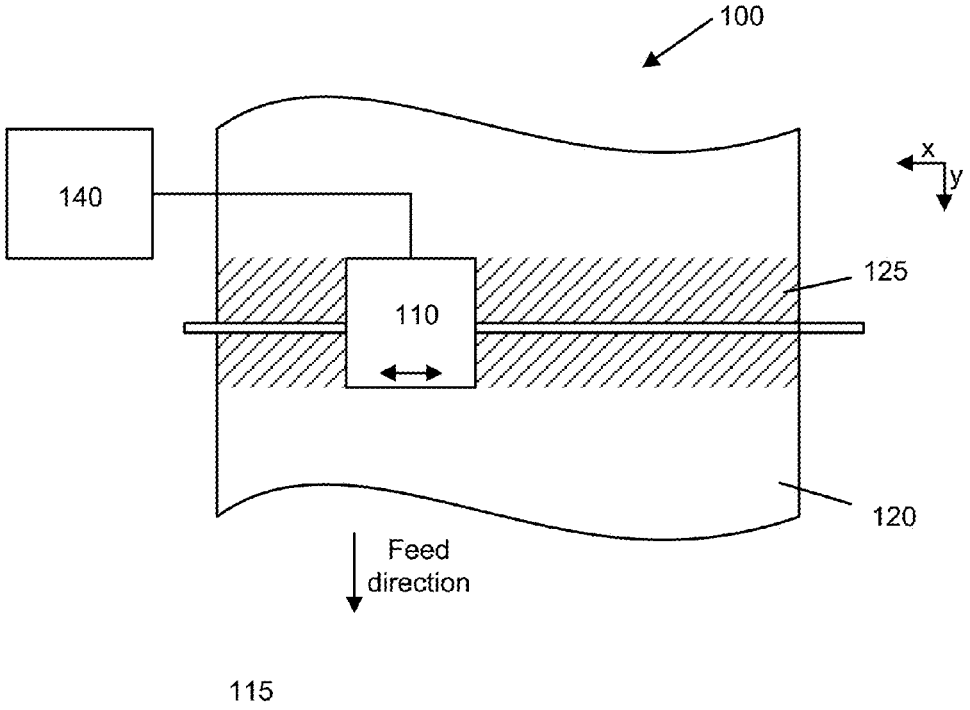
FIG. 1 shows an example of a printing device.

FIG. 1 illustrates an example of a printing device 100 having a printhead 110 that is moveable perpendicular to a feed direction 130 of a print medium 120. Herein, the feed direction is a direction in which the medium 120 is fed, and will be referred to as the y-direction. The direction substantially in the plane of the medium and perpendicular to the y-direction will be referred to as the x-direction. Herein, references such as "along the x-direction," include both positive and negative x-directions. That is, the sign of the x-direction is not significant.

A printer control section 140 controls the printhead 110, and may also control other functions, such as feeding of medium 120.

The printhead 110 may be an ink jet printhead. The printhead 110 may have a plurality of nozzles for depositing pretreatment and/or color ink onto the medium 120. The nozzles may be arranged in a matrix.

The printhead 110 is arranged to apply a pretreatment to the medium, and following the pretreatment may apply one or more colored inks to the medium. The pretreatment may improve the image quality, for example by modifying an interaction between the medium and the color ink. The effect of the pretreatment may depend on various parameters, such as the medium and ink, as well as an amount of pretreatment applied, a time between application of the pretreatment and application of the color ink, and ambient conditions (temperature, humidity, etc.) Where the pretreatment parameters are poorly chosen the quality of the printed image may be reduced, for example due to bleed and/or coalescence. In some cases, a period between applying a pretreatment and applying a color ink over the pretreatment can affect wetting of the media by the pretreatment and/or the drying of the pretreatment, which can affect image quality.

The printhead 110 prints on the medium in swaths. Herein a swath refers to a portion of the medium 120 that can be printed on by the printhead 110 without moving the medium relative to the printhead 110 along the y-direction 130. As the printhead 110 is moveable across the medium 120 in the x-direction, the swath defines a strip of the medium 120 that extends across the medium 120 and has a width in the y-direction corresponding to the length of the print footprint of the printhead 110 in the y-direction. Here, the print footprint describes the area of the medium 120 that is printable by the printhead 110 without relative movement between the printhead and the medium 120. A swath is illustrated in FIG. 1 as shaded area 125.

In operation, the control section 140 may control the printhead 110 to perform a plurality of passes over each swath of the medium to place pretreatment or ink onto the medium 120. In each pass the printhead 110 is moved relative to the medium 120 in the x-direction. Each pass may extend substantially across the width of the medium 120 in the x-direction.

When the required number of passes has been completed for a swath, the medium 120 may be fed along the y-direction 130 to expose the next swath to the printhead 110.

For each swath, the printhead 110 may perform a plurality of pretreatment passes, and may also perform one or more color passes. Pretreatment is applied in pretreatment passes, and color ink is applied in color passes. In some examples pretreatment may be applied to the whole swath, while in other examples the pretreatment may be applied to only part of the swath. In some examples the pretreatment may be applied uniformly, while in other examples the pretreatment is applied with different concentrations in different parts of the swath. The control section 140 may receive or generate pretreatment data that indicates the portions of the medium 120 that are to receive pretreatment. The pretreatment data may also identify the concentration of pretreatment that is to be applied.

For each pass in which pretreatment is applied, referred to herein as a pretreatment pass, a pretreatment mask is applied that defines the portions of the swath that may receive pretreatment in that pass. The number of pretreatment masks is equal to the number of pretreatment passes to be applied to the swath.

The medium may be considered as a plurality of pixels that may each receive pretreatment and/or ink. The pixels may be arranged in a rectangular grid, for example. Within a single pass the pretreatment is applied only to those pixels identified as printable by the pretreatment mask. In some examples, each of the pixels of the swath is identified as printable in at least one pass. In some examples, each of the pixels of the swath is identified as printable in exactly one pass. In some examples, each of the pixels of the swath is identified as printable in more than one pass, the number of passes in which each pixel is printable may be the same for all pixels.

Figure 2B:
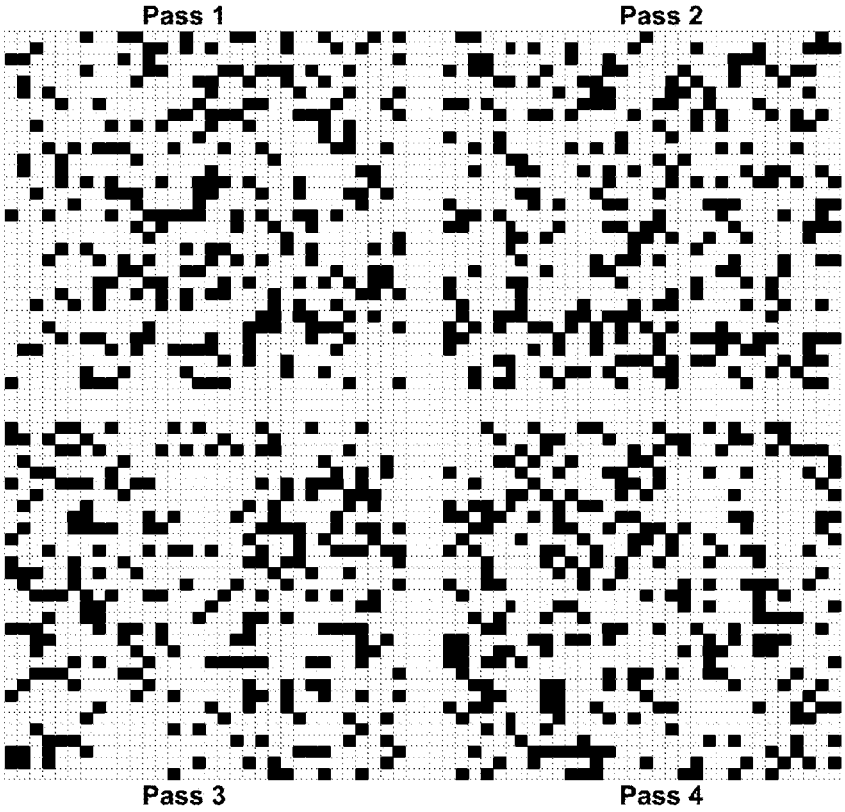

FIG. 2 shows an example of pretreatment masks for a swath having 4 passes. FIG. 2*a* illustrates a matrix of pixels that are printable by the print head. Each cell corresponds to one pixel, and the number in each cell corresponds to the pass on which that pixel is printable. "0" corresponds to the first pass, "1" corresponds to the second pass, "2" corresponds to the third pass, and "3" corresponds to the fourth pass. FIG. 2*b* shows each of the pretreatment masks: the grid represents an array of pixels, and a shaded square indicates a pixel that can be printed in the corresponding pass.

FIG. 2 shows a proportional mask, in which each pass has substantially the same number of printable pixels. There are 32×32=1024 pixels in total, so each pretreatment mask has 1024/4=256 printable pixels. The non-printable pixels in each pretreatment mask are shown in unshaded in FIG. 2*b*.

The proportion of printable pixels to the total number of pixels in a pretreatment mask may be referred to herein as the weight of the mask. For example, each of the masks in FIG. 2 has a weight of ¼ or 25%.

FIG. 2 illustrates a random mask, in which the pixels are assigned to the four pretreatment masks at random, subject to the constraint that there are equal numbers of printable pixels in each mask.

Figure 3A:
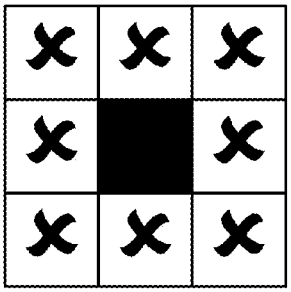
FIGS. 3*a* and 3*b* show examples of rules for generating a pretreatment mask.
Figures 3B, 4A:
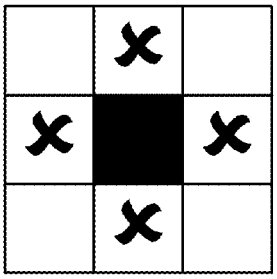
FIGS. 4*a* and 4*b* show an example of a non-proportional pretreatment mask.

FIG. 3 illustrates rules that may be applied in generating a pretreatment mask. FIG. 3*a* illustrates a rule that a pretreatment mask may not include any pair of neighboring pixels: The shaded square represents a printable pixel of the current mask, and "x" represents a pixel that may not be printable in the same mask. FIG. 3*b* illustrates a rule that no horizontal or vertical neighbors (edge-sharing neighbors) may be printable in a pretreatment mask immediately following the current mask. The shaded square represents a printable pixel of the current mask, and "x" represents a pixel that may not be printable in the immediately following pass. The rules of FIGS. 3*a* and 3*b* may be applied alone or in combination, or may not be applied at all. Other rules could also be applied, by applying constraints based on nozzles or groups of nozzles corresponding to the pixel or pixels, and/or rules based on layers (e.g. half-tone value dependent, etc), for example. In some examples the rules may include weighters indicating a probability of printing a pixel in a particular pass; the weighters may depend on nozzles or groups of nozzles corresponding to the pixel or pixels, for example. In some examples the distribution is based on, or similar to, a distribution that is known to produce satisfactory image quality, such as a distribution based on blue noise or white noise.

Figure 4B:
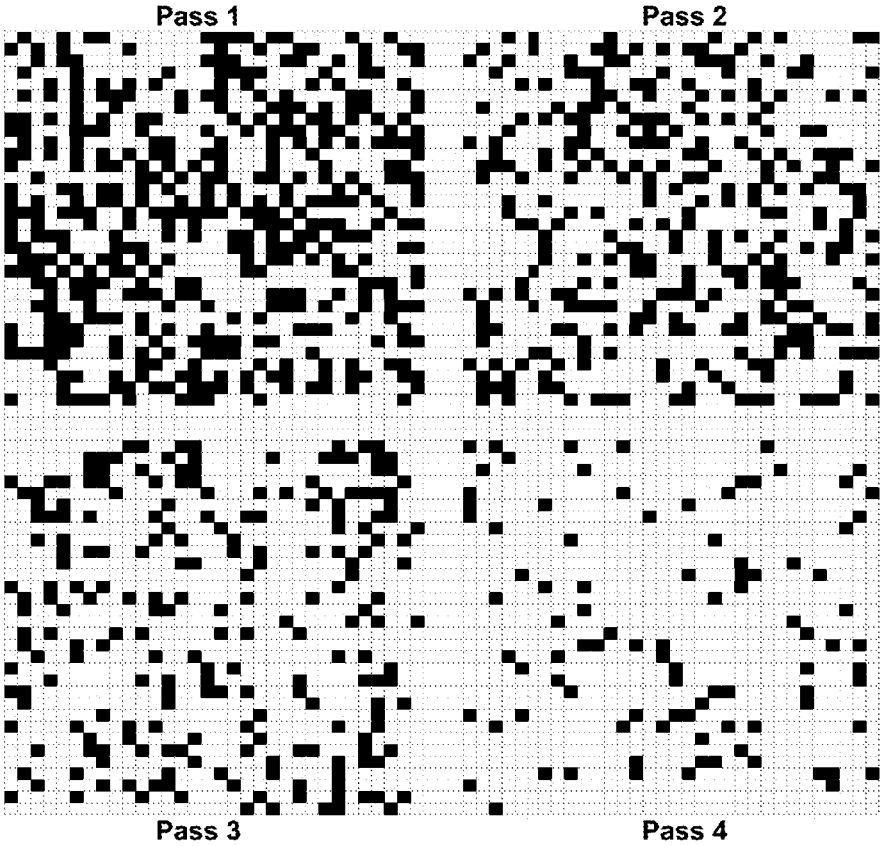

FIG. 4 illustrates a non-proportional mask for a swath having four passes. FIGS. 4*a* and 4*b* are similar to FIGS. 2*a* and 2*b*, respectively, except that the pretreatment masks of FIG. 4 have different numbers of printable pixels in each of the passes (i.e. have different weights). By allowing the passes to have different numbers of printable pixels flexibility is improved.

In the example of FIG. 4, each of the second to fourth pretreatment masks has a lower weight that the preceding mask. This is clear from a comparison of the number of printable pixels (shown as back squares) in FIG. 4*b*. Thus, the weight of the masks decreases with increasing sequence number (i.e. numbered in sequence according to order of application).

In some examples color passes may be performed on the swath following the pretreatment passes. In such cases, the pretreatment applied in the first pretreatment pass has more time to wet the medium or to dry than the pretreatment in subsequent pretreatment passes. Accordingly, in the example of FIG. 4 the pretreatment from the first pretreatment pass has longer to dry than the pretreatment applied in the second pretreatment pass, which in turn has longer to dry than the pretreatment in the third pretreatment pass, etc. This arrangement may take advantage of the improved drying time that results from applying the pretreatment in multiple passes, while increasing the average time between applying pretreatment to a pixel and applying color ink to a pixel.

By using a non-proportional pretreatment mask, the curing time and/or time for an initial drying process between applying a pretreatment and applying a color ink on top of the pretreatment can be flexibly controlled. In some examples this may reduce or eliminate a need for a delay or pause in printing between pretreatment passes and color passes. In some examples this may reduce or remove the need for additional components, such as a heater or dryer to control the curing of the pretreatment. Some examples allow proper (or desired) rheological behavior of a pretreatment to be obtained with little or no increase in print time specifically to allow for drying, and/or without requiring forced drying/curing (e.g. by a heating or drying element). Thus is may be possible to rely on natural drying of the pretreatment.

Figure 5:
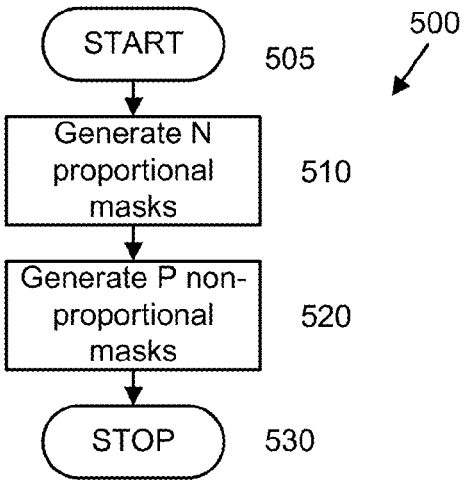
FIG. 5 shows a method of generating non-proportional pretreatment masks.

FIG. 5 shows a method 500 of producing a non-proportional pretreatment mask, such as the mask shown in FIG. 4. Where there are to be P pretreatment passes for each swath, P pretreatment masks are required. The method begins at step 505, and at step 510, N proportional masks are generated, with N>P. The proportional masks have equal weighting of 1/N, such that the number of printable pixels in each mask is K/N, where K is the total number of pixels in the mask. The proportional masks may be generated randomly and/or according to rules, such as those described in relation to FIG. 3.

At 520 P non-proportional masks are generated by combining one or more of the N proportional masks to produce each of the P non-proportional masks. Each of the N proportional masks are assigned to, or associated with, exactly one non-proportional mask. The printable pixels in each non-proportional mask correspond to all of the printable pixels in the proportional masks from which it is generated. For example, if the set of printable pixels in the ith proportional mask is $N_i$, the set of printable pixels in the non-proportional mask generated from the first and second proportional masks is $N_1 \cup N_2$.

The ith non-proportional mask has a weight of $s_i$,K/N, where $s_i$ is the number of proportional masks assigned to the ith non-proportional mask. To produce the non-proportional masks, not all of the weights of the non-proportional masks are equal. Thus, at least one pair of non-proportional masks are generated from different numbers of proportional masks.

As an example, where there are to be 4 passes (P=4), it is possible to generate 10 proportional masks (N=10). The proportional masks may be combined as in the following table to generate the 4 non-proportional masks.

| Non-proportional mask | Proportional masks | weight |
|---|---|---|
| 1 | 1, 2, 3, 4 | 40% |
| 2 | 5, 6, 7 | 30% |
| 3 | 8, 9 | 20% |
| 4 | 10 | 10% |

The method 500 terminates at 530.

Figure 6:
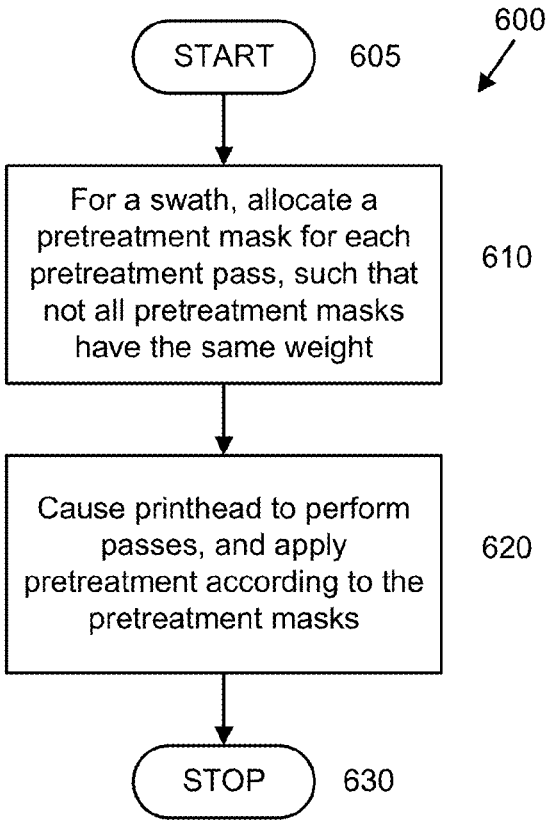
FIG. 6 shows a method according to an example.

FIG. 6 shows a method 600 according to an example. The method begins at 605. At 610 a pretreatment mask is allocated for at least first and second passes over a swath. At 620 the printhead 110 pretreats the medium 120 according to the allocations of 610. Each pretreatment mask allocated at 610 indicates a corresponding set of pixels to which the pretreatment may be applied in the corresponding pass. The allocations of 610 are such that the pretreatment masks of the first and second passes are such that a weight of the first pretreatment mask is different from a weight of the second pretreatment mask. It is noted that there may be additional passes, possibly including passes before the first pass, and/or between the first and second pass.

FIG. 7 shows an example in which the pretreatment is not to be applied to a whole swath. In the example of FIG. 7, FIG. 7*a* shows a group of pixels that are to receive a pretreatment within a part of a swath. In this example the shaded pixels in on the left are to be pretreated, but no pretreatment is to be applied to the unshaded pixels on the right.

FIG. 7*b* shows an example of a non-proportional print mask, where two pretreatment passes are to be performed on the swath. The pixels labeled "0" are to receive pretreatment in the first pass, and the pixels labeled "1" are to receive pretreatment in the second pass.

FIG. 7*c* shows the pixels that receive pretreatment in the first pass as solid circles. Pixels that are printable in the first pass (based on the corresponding pretreatment mask), but are not to be printed in this swath are shown as open circles. FIG. 7*d* shows the pixels that receive pretreatment in the second pass as solid circles. Pixels that are printable in the second pass, but are not to be printed in this swath are shown as open circles. Within a particular pass, a pixel has pretreatment applied only if it is to receive pretreatment in that swath, and if it is a printable pixel according to the mask applied to the current pass.

In some examples, each mask may be defined for the whole swath. In other examples, each mask may be defined for a part of the swath and repeated, mirrored, or alternated with one or more other partial masks to generate the mask for the whole swath. In some examples, the mask is defined for the pixels within the print footprint of the printhead, and repeated across the swath.

In some examples, after the pretreatment passes, color ink is applied to the swath over the pretreatment in one or more color passes. Where multiple color passes are performed, color masks may be applied to the color passes, in an analogous manager to the pretreatment masks described above.

According to some examples, the color masks may be proportional masks. According to some examples, the color masks may be non-proportional masks. This can further increase flexibility, and allow further tuning of the pretreatment parameters.

According to some examples, the non-proportional color masks have an increasing weight with sequence number. Accordingly, an average time interval between applying a pretreatment to a pixel and applying a color ink to the pixel may be further increased.

In some cases it is desirable for the pretreatment masks to have decreasing weight with sequence number. However, there may also be cases in which improved results can be achieved with increasing weights or non-monotonic weights with pretreatment mask sequence number.

In some examples it may be possible to apply different amounts of pretreatment and/or color ink to each pixel. For example, it may be possible to apply ink drops of different sizes. This does not change the operation of the pretreatment masks and color masks described above.

According to the examples described above, all passes are completed over one swath and then the medium is fed such that the next swath is below the printhead 110, and the next swath is printed by a plurality of passes. However, in some examples the medium is fed only a fraction of the swath width (in the y-direction). For example, the medium may be fed by ½ or ⅓ the width of the swath. In this case, the masks may be modified to take into account the overlap of the swaths.

In some examples, the printing process may be an inkjet printing process, such as a thermal or piezoelectric printing process. Some examples the printing process may be a print-on-demand process. Some examples may make use of a latex ink system.

In some examples the pretreatment may be a water based vehicle with a cationic polymer that increases its viscosity when in contact with the different color pigments. In some examples the pretreatment may include other components, such as surfactants, dispersants, etc.

In some examples the color inks are include water as a solvent. Other solvents could be used. In some examples the color inks include latex polymer particles and pigment particles.

In some examples the above masking arrangement may be applied to a post-treatment instead of, or as well as, a pretreatment. In some examples the weight of post-treatment masks may increase with sequence number, which may increase the average time period between applying a color ink to a pixel and applying a post-treatment to the pixel. Post-treatments may enhance image print quality, and may include a varnish and/or a fixer, for example. Herein, the term "treatment" is used to mean pretreatment and/or post-treatment.

The control section 140 may be implemented using any combination of hardware and/or software, and may include one or more of a processor, volatile memory, non-volatile memory, etc.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or compounds described in conjunction with a particular aspect or example are to be understood to be applicable to any other aspect or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing examples. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A printer control section to cause a printhead to:

perform a first pass over a swath of a print medium on which the printhead can print along a direction without the medium moving relative to the printhead in a perpendicular direction;

apply an amount of treatment on the swath in the first pass according to a first treatment mask indicating a first set of pixels in which the treatment may be applied and having a weight indicative of a proportion of pixels in the first set;

perform a second pass over the swath after the first pass without moving the print medium relative to the printhead perpendicular to an axis of movement of the first pass and the second pass, and without applying ink on the swath;

apply a different amount of the treatment on the swath in the second pass according to a second treatment mask indicating a second set of pixels in which the treatment may be applied and having a different weight indicative of a portion of pixels in the second set; and apply the ink on the swath after the second pass.

2. The printer control section of claim 1, wherein a greater amount of treatment is applied in the first treatment pass than an amount of treatment applied in the second treatment pass.

3. The printer control section of claim 1, wherein the different weight of the second treatment mask is lower than the weight of the first treatment mask.

4. The printer control section of claim 1, wherein the treatment is a pretreatment, and the ink is colored ink.

5. The printer control section of claim 4, wherein the colored ink is applied on top of the pretreatment.

6. The printer control section of claim 4, wherein the colored ink is applied to the swath in a plurality of color printing passes having respective weights, and the weights of the color printing passes increase for each consecutive pass.

7. The printer control section of claim 1, wherein the printhead is to perform P treatment passes over the swath, including the first pass and the second pass, and the control section is to determine a set of N print masks, where N is greater than P, each of the N print masks having equal weight, and the control section is to assign each of the N print masks to one of the P treatment passes to form the treatment masks.

8. The printer control section of claim 7, wherein more of the N print masks are assigned to the first pass than to the second pass.

9. A method comprising:

performing, by a printhead, a first pass over a swath of a print medium on which the printhead can print along a direction without the medium moving relative to the printhead in a perpendicular direction;

applying, by the printhead, an amount of treatment on the swath in the first pass according to a first treatment mask indicating a first set of pixels in which the treatment may be applied and having a weight indicative of a proportion of pixels in the first set;

performing, by the printhead, a second pass over the swath after the first pass without moving the print medium relative to the printhead perpendicular to an axis of movement of the first pass and the second pass and without applying ink on the swath;

applying, by the printhead, a different amount of the treatment on the swath in the second pass according to a second treatment mask indicating a second set of pixels in which the treatment may be applied and having a different weight indicative of a portion of pixels in the second set; and applying, by the printhead, the ink on the swath after the second pass.

10. The method of claim 9, wherein the different weight of the second treatment mask is lower than the weight of the first treatment mask.

11. The method of claim 9, wherein the treatment is a pretreatment and the ink is colored ink.

12. The method of claim 11, wherein the colored ink is applied on top of the pretreatment.

13. The method of claim 11, wherein the colored ink is applied to the swath in a plurality of color printing passes having respective weights, and the weights of the color printing passes increase for each consecutive pass.

14. The method of claim 9, wherein the printhead performs P treatment passes over the swath, including the first and the second pass, and the method further comprises:

determining a set of N print masks, where N is greater than P, each of the N print masks having equal weight, and assigning each of the N print masks to one of the P treatment passes to form the treatment masks.

15. The method of claim 14, wherein more of the N print masks are assigned to the first pass than to the second pass.

16. A printer comprising:

a printhead; and a controller to cause the printhead to:

perform a first pass over a swath of a print medium on which the printhead can print along a direction without the medium moving relative to the printhead perpendicular to an axis of movement of the first pass and the second pass in a perpendicular direction;

apply an amount of treatment on the swath in the first pass according to a first treatment mask indicating a first set of pixels in which the treatment may be applied and having a weight indicative of a proportion of pixels in the first set;

perform a second pass over the swath after the first pass without moving the print medium relative to the printhead or applying ink on the swath;

apply a different amount of the treatment on the swath in the second pass according to a second treatment mask indicating a second set of pixels in which the treatment may be applied and having a different weight indicative of a portion of pixels in the second set; and apply the ink on the swath after the second pass.

* * * * *